US011207605B2

(12) United States Patent
Flynn

(10) Patent No.: US 11,207,605 B2
(45) Date of Patent: Dec. 28, 2021

(54) WIRE ROPE AND TRACK TRANSPORT SYSTEM

(71) Applicant: Christopher Michael Flynn, Deer Harbor, WA (US)

(72) Inventor: Christopher Michael Flynn, Deer Harbor, WA (US)

(73) Assignee: Christopher M Flynn

( * ) Notice: Subject to any disclaimer, the term of this patent is extended or adjusted under 35 U.S.C. 154(b) by 10 days.

(21) Appl. No.: 16/267,382

(22) Filed: Feb. 4, 2019

(65) Prior Publication Data

US 2020/0206641 A1 Jul. 2, 2020

Related U.S. Application Data

(60) Provisional application No. 62/626,025, filed on Feb. 3, 2018.

(51) Int. Cl.

| | |
|---|---|
| ***A63G 21/22*** | (2006.01) |
| ***A63G 21/20*** | (2006.01) |
| ***B61B 7/00*** | (2006.01) |
| *B61B 12/12* | (2006.01) |

(52) U.S. Cl.

CPC ..... *A63G 21/22* (2013.01); *A63G 21/20* (2013.01); *B61B 7/00* (2013.01); *B61B 12/122* (2013.01)

(58) Field of Classification Search

CPC ..... B61B 7/00; B61B 12/007; B61B 12/02; B61B 12/026; B61B 12/122; E01B 25/10; A63G 21/20; A63G 21/22

USPC ..... 104/87

See application file for complete search history.

(56) References Cited

U.S. PATENT DOCUMENTS

| | | | | |
|---|---|---|---|---|
| 1,365,685 | A * | 1/1921 | Hansen | E01B 25/10 104/87 |
| 1,419,684 | A * | 6/1922 | Neller | E01B 25/18 104/87 |
| 7,823,511 | B2 * | 11/2010 | Lins | A63G 21/22 104/127 |
| 8,499,696 | B2 * | 8/2013 | Tilley | B61B 12/02 104/87 |
| 8,640,626 | B2 * | 2/2014 | Perry | E01B 25/16 104/87 |
| 8,640,627 | B1 * | 2/2014 | Perry | E01B 25/16 104/87 |
| 2011/0083577 | A1 * | 4/2011 | Tilley | B61B 7/06 104/96 |
| 2013/0125776 | A1 * | 5/2013 | Perry | F16H 7/18 104/87 |
| 2014/0096699 | A1 * | 4/2014 | Kitchen | A63G 7/00 104/53 |

* cited by examiner

*Primary Examiner* — Zachary L Kuhfuss

(57) ABSTRACT

A mechanical assemblage similar to a traditional zipline, where a wheeled cart travels with the assistance of gravity along a guide cable strung between two points. However, this new system allows the cart to travel further, along multiple segments of guide cable and track, connected to each other by an unique attachment system which allows the cart to travel unabated, from cable to track and back to cable, by allowing the mounting attachments for the track segments to pass through an opening in the side of the cart and then close the opening to make it impossible for the guide cable to escape the cart, while riding on the guide cable. This is the most compact, simple and highly functional solution yet presented for genuine cable and track zipline system able to function with only the potential energy of gravity.

6 Claims, 15 Drawing Sheets

WIRE ROPE AND TRACK TRANSPORT SYSTEM

CROSS-REFERENCED TO RELATED APPLICATION

This application claims the benefit of PPA Ser. No. 62/626,025, filed 2018 Feb. 3, by the present inventor.

FEDERALLY SPONSORED RESEARCH

None.

BACKGROUND

The present invention relates to transport systems using a combination of track and wire rope supporting a wheeled carriage designed to carry a hanging payload around a course comprising straight and curved segments, similar transport systems can be found in mining dating back to the 1800's.

A traditional zipline is confined to travel only between two points, within the restrictions of a guide-cable's catenary curve. Other systems successfully convey a carriage around a course consisting of straight and curved sections of track, often called a roller coaster. Combining the elements of a cable zipline with those of a rollercoaster track presents several engineering challenges. The carriage which rides along the wire rope must not be allowed to derail under any circumstances. The carriage must be allowed to travel smoothly from wire rope to track and back to another wire rope, unabated.

SUMMARY

An improved method or apparatus for transporting a payload on a wire rope and track combination is presented.

One possible embodiment of this invention is presented as a system or method of allowing a wheeled carriage to safely transfer between wire rope segments and track segments without the ability of unintentionally detaching from either. This is accomplished by providing a carriage frame that wraps around the wire rope segment or track segment with a pass through slot on one side that allows the wheeled carriage to pass freely over the track without contacting the track segment support structure, and by providing a spring loaded retention device to prevent the carriage from coming off the wire rope segments, that is pushed down into an open position by the track segment as the carriage transfers to from the wire rope segment to the track segment and is released into the closed position as the carriage transfers from the track segment to the wire rope segment. A latch locking device of any type used in the art may be used to secure the spring loaded retention device in the closed position, and be deactivated by the track. A torsion management device may also be used to limit the twisting moment of the cart on the track caused by the centrifugal force of the payload going around a curve. This torsion management device may comprise a friction resistant material or wheels.

A further embodiment of this invention is an improved coupling between the wire rope sections and the track sections. This is accomplished with the use a plurality of swages on the wire rope, each in a coupling socket in the track. While the primary swage takes all the initial load of the coupling, the second swage (or third swage) only takes the load if the primary swage fails. A frangible indicator that is placed between the second swage and the coupling socket, releasing a bright marker that clearly indicates visually that the primary swage has failed, yet still retains the original strength with the second swage.

In another embodiment of this invention, the cart may be motorized, such that it is able to propel itself along the guide cable and track-segments.

In a further embodiment of this invention, the cart may include a braking system to regulate the speed of its progress through a course.

In a further embodiment of this invention, the cart may be equipped with telemetry and automation which would allow the maintenance of appropriate proximity between carts.

In a further embodiment of this invention, the course may include a propulsion system which may apply force upon the cart to facilitate movement at a desired speed, along the course.

In a further embodiment of this invention, a wire rope segment may be lowered down to facilitate easy wheel chair access to the system.

In a further embodiment of this invention, the ground supports may be replaced with areal balloons, drones or floating supports on water.

In a further embodiment of this invention, a track segment may include a flexible free tab at one or both ends that may be bent or twisted to be aligned with the wheeled carriage.

DRAWINGS

REFERENCE NUMERALS

Figure 1:
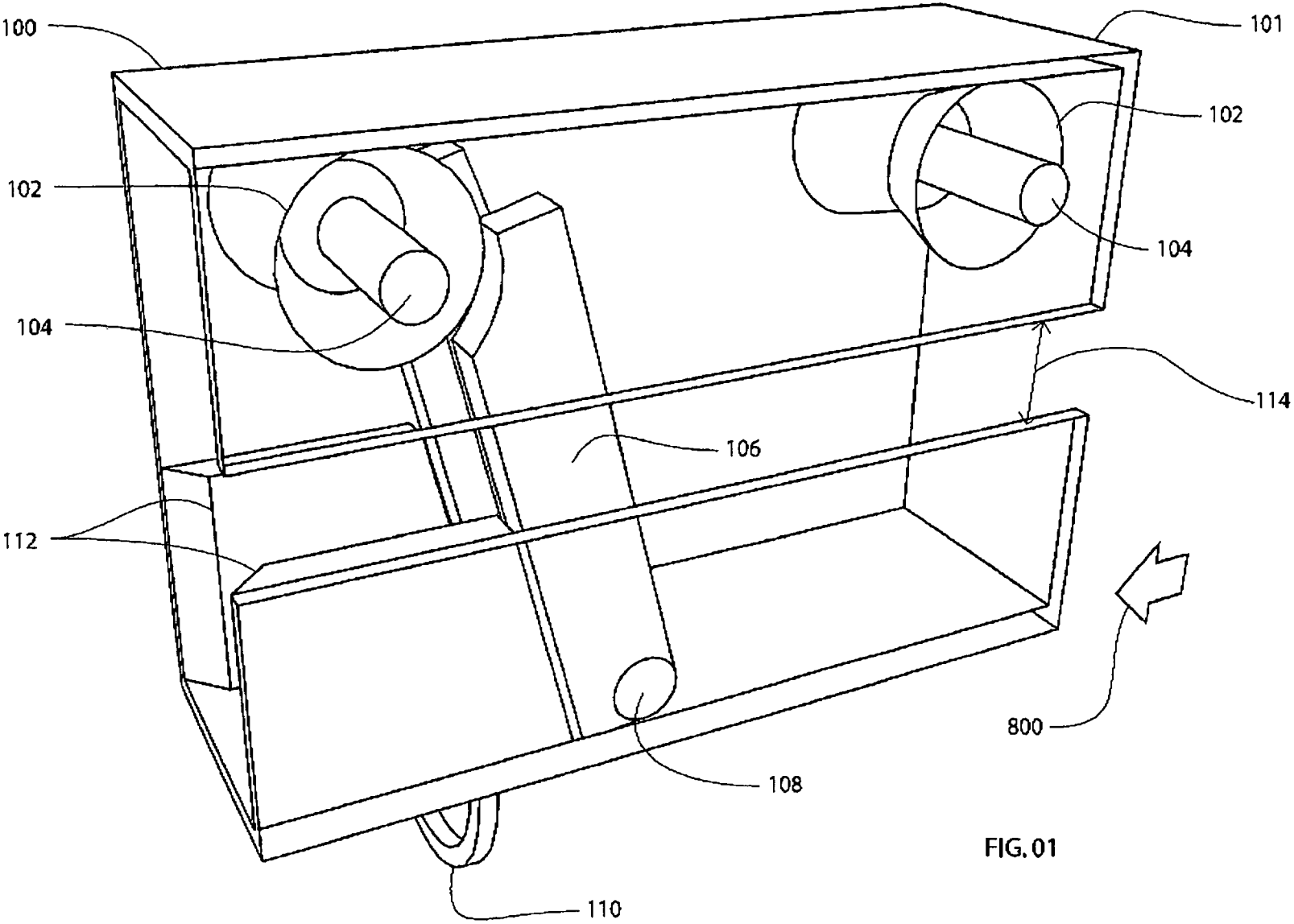
FIG. 01 shows a side perspective illustration of one embodiment of a wheeled carriage in accordance with the invention.

100 wheeled carriage
101 carriage frame
102 wheel
104 axel
106 spring loaded retention device
108 retention device fulcrum
110 hanging payload attachment point
112 torsion management device
114 pass-through slot
120 116 wire rope retention channel
200 track segment
202 track hanger
204 track rigging attachment point
206 retention device deactivation interface
208 track free tab
210 short track mount yoke
212 track rigidity tab
214 track rigidity tab retainer
216 track mount yoke
130 218 track mount pivot
220 track mount surface
222 track segment end taper
300 wire rope coupling socket
302 wire rope coupling channel
304 wire rope coupling plate
306 wire rope coupling plate alignment holes
400 wire rope segment
402 primary coupling swage
404 secondary coupling swage
406 frangible indicator
500 rigging cable
600 support structure
700 track support truss
702 track support truss pivot
704 track support truss telescoping boom
800 direction of rolling
802 direction of movement for opening spring loaded retention device
803 direction of movement for closing spring loaded retention device

DETAILED DESCRIPTION

As required, detailed embodiments of the present invention are disclosed herein; however, it is to be understood that the disclosed embodiments are merely exemplary of the invention that may be embodied in various and alternative forms. Specific structural and functional details, and shapes disclosed herein are not to be interpreted as limiting, but merely as a basis for the claims and as a representative basis for teaching one stalled in the art to variously employ the present invention.

Description—FIG. 01

FIG. 01 shows a side perspective illustration of one embodiment of the present invention with carriage 100 comprising carriage frame 101 with direction of rolling 800, supporting wheels 102 with axels 104 and pass-through slot 114. Spring loaded retention device 106 is pivotally attached to carriage frame 101 at fulcrum 108. Spring not shown. Hanging payload attachment point 110 is attached to carriage frame 101. A torsion management device 112, comprising abrasive resistant material or wheels (not shown) is attached to carriage frame 101 to limit rotation of carriage 100 upon the track. Parts of carriage frame 101 are shown in a transparent manner so inner workings can be seen.

Figure 2:
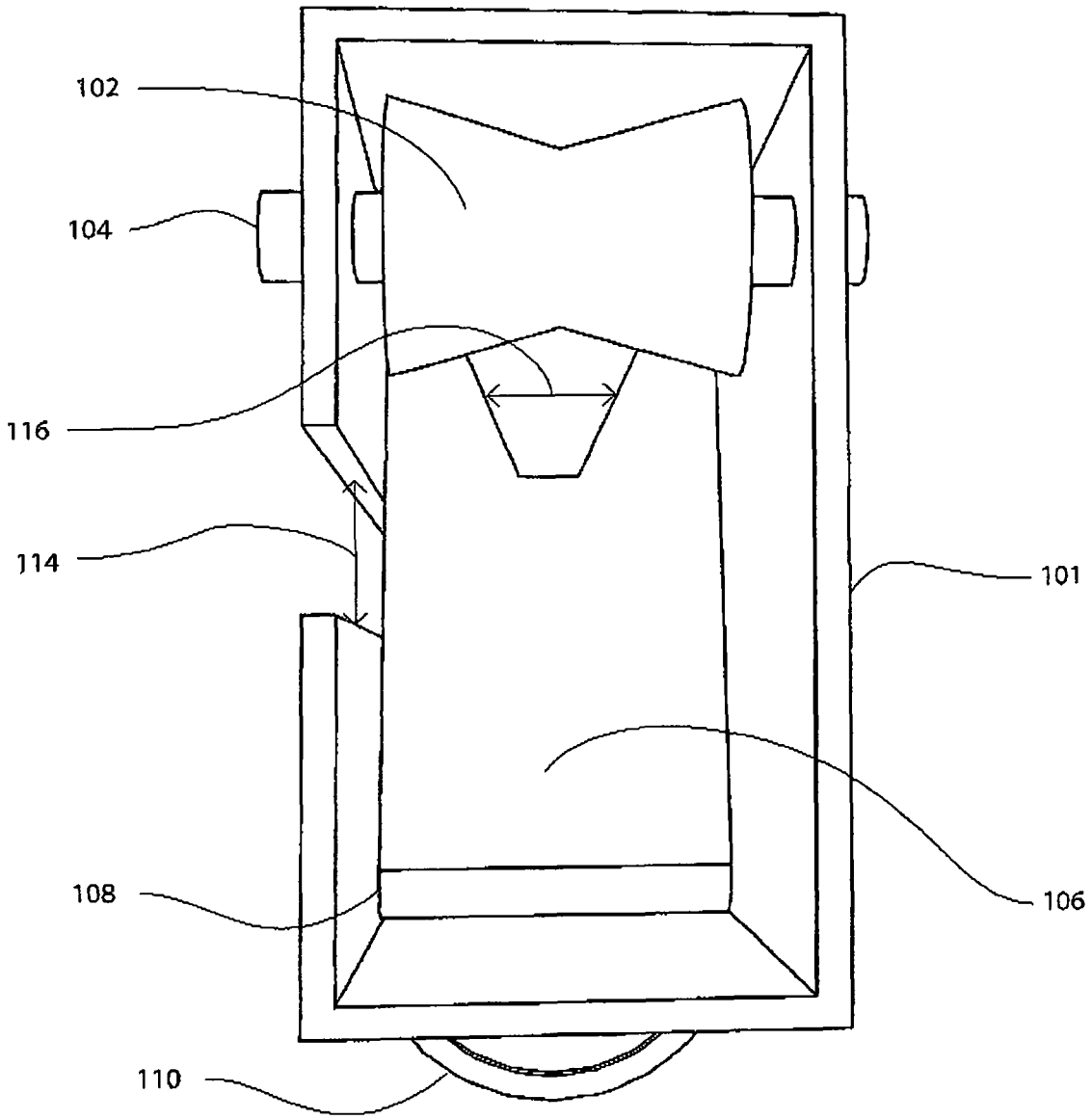
FIG. 02 shows an aft perspective illustration the same embodiment shown in FIG. 01.

Description—FIG. 02

FIG. 02 shows an aft perspective illustration the same embodiment of the present invention with carriage frame 101 supporting wheels 102 with axels 104 and pass-through slot 114. Wire rope retention channel 116 is visible in spring loaded retention device 106, shown in closed position, which is pivotally attached to carriage frame 101 at fulcrum 108. Spring not shown. Hanging payload attachment point 110 is attached to carriage frame 101.

Figure 3:
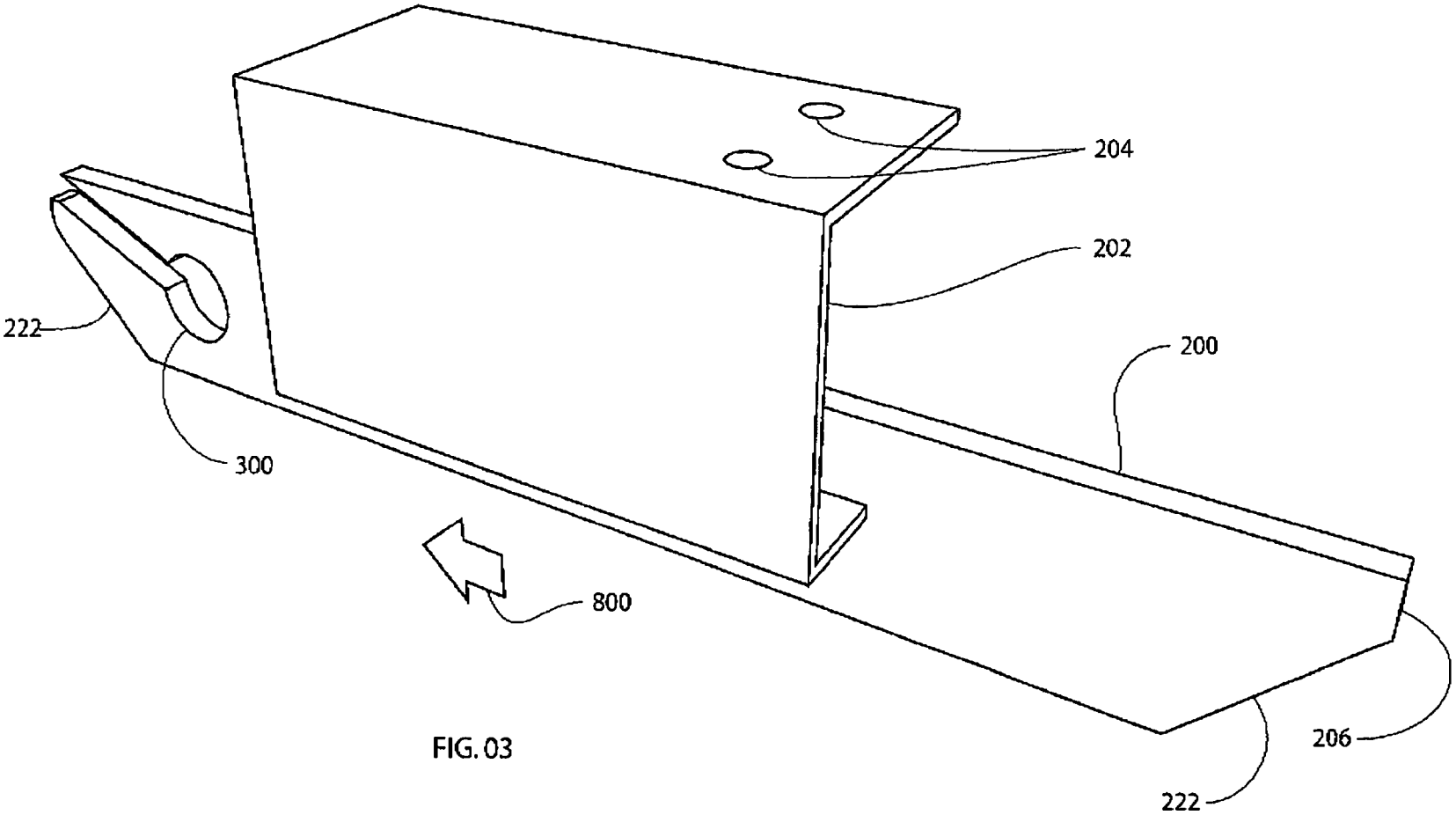
FIG. 03 shows side perspective illustration of one embodiment of an entrance track segment with track hanger structure in accordance with the invention.

Description—FIG. 03

FIG. 03 shows a side perspective illustration of one embodiment of an entrance track segment with track segment 200 with track segment end tapers 222, attached to track hanger 202 with track rigging attachment points 204 and retention device deactivation interface 206 and wire rope coupling socket 300. Also shown is the direction of rolling 800 of carriage 100 (not shown).

Operation—FIG. 03

To operate this embodiment, carriage 100 (not shown) is rolled onto track segment 200 in direction of rolling 800 whereby retention device deactivation interface 206 makes contact with spring loaded retention device 106 and pushes it into an open position.

Figure 4:
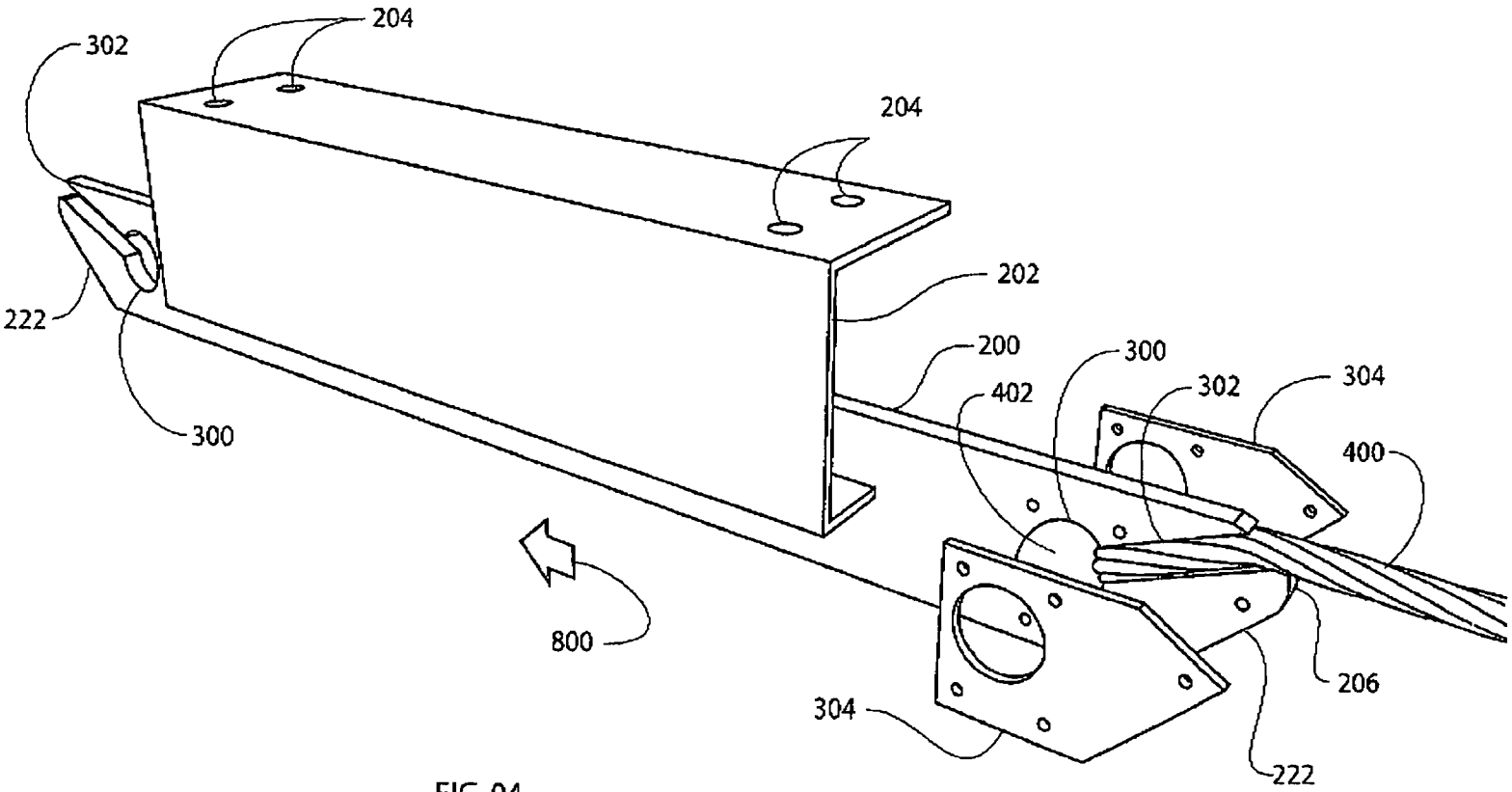
FIG. 04 shows side perspective illustration of one embodiment of a typical track segment with cable attachment detail in accordance with the invention.

Description—FIG. 04

FIG. 04 shows side perspective illustration of one embodiment of a typical track segment with track segment 200 with track segment end tapers 222, attached to track hanger 202 with track rigging attachment points 204. Wire rope segment 400 terminates in wire rope coupling swage 402 that is held in wire rope coupling channel 302 and wire rope coupling socket 300 respectively. Wire rope coupling plates 304 are attached to track segment 200 by any suitable method to retain wire rope segment 400 and wire rope coupling swage 402 securely. Also shown is the direction of rolling 800 of carriage 100 (not shown). Track segment 200 may be of any length required and may have as many rigging attachment points 204 as deemed necessary for installation of a given course, and may be curved or straight. The guide cable retention hole 300 is formed specifically to accommodate whatever kind of wire rope terminator that is selected. This wire rope terminator may be a swaged socket, a speltered socket, a wedge socket or any other type of wire rope terminator deemed appropriate by someone knowledgeable in the art, where, such a fitting is of a shape and size so as to allow it to pass through carriage 100 (not shown), while also supporting a sufficient amount of tension from wire rope 400. Two or more swages may also be used (not shown).

Figure 5:
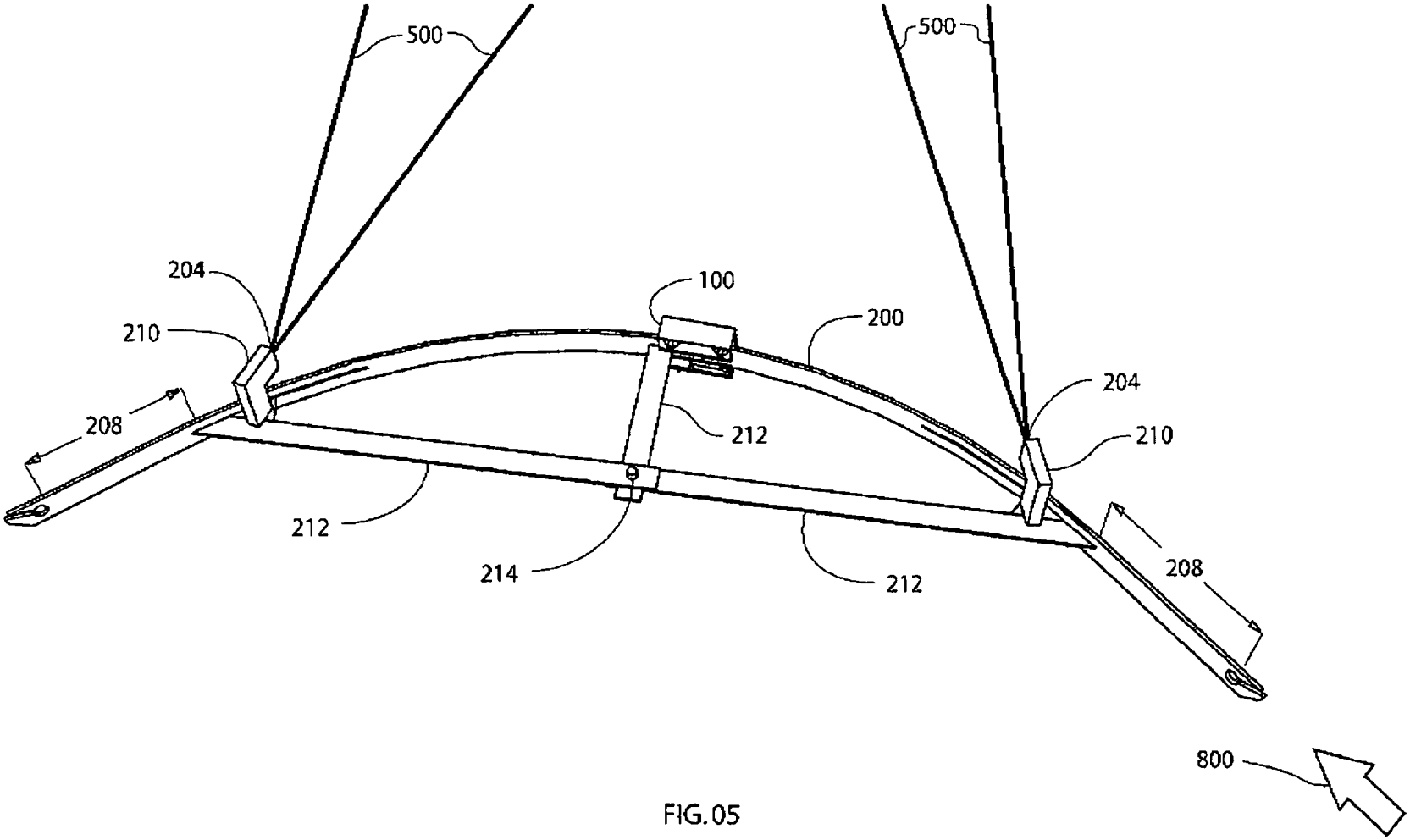
FIG. 05 shows side perspective illustration of one embodiment of a left curved track segment with flexible attachments to a support structure in accordance with the invention.
Figure 6:
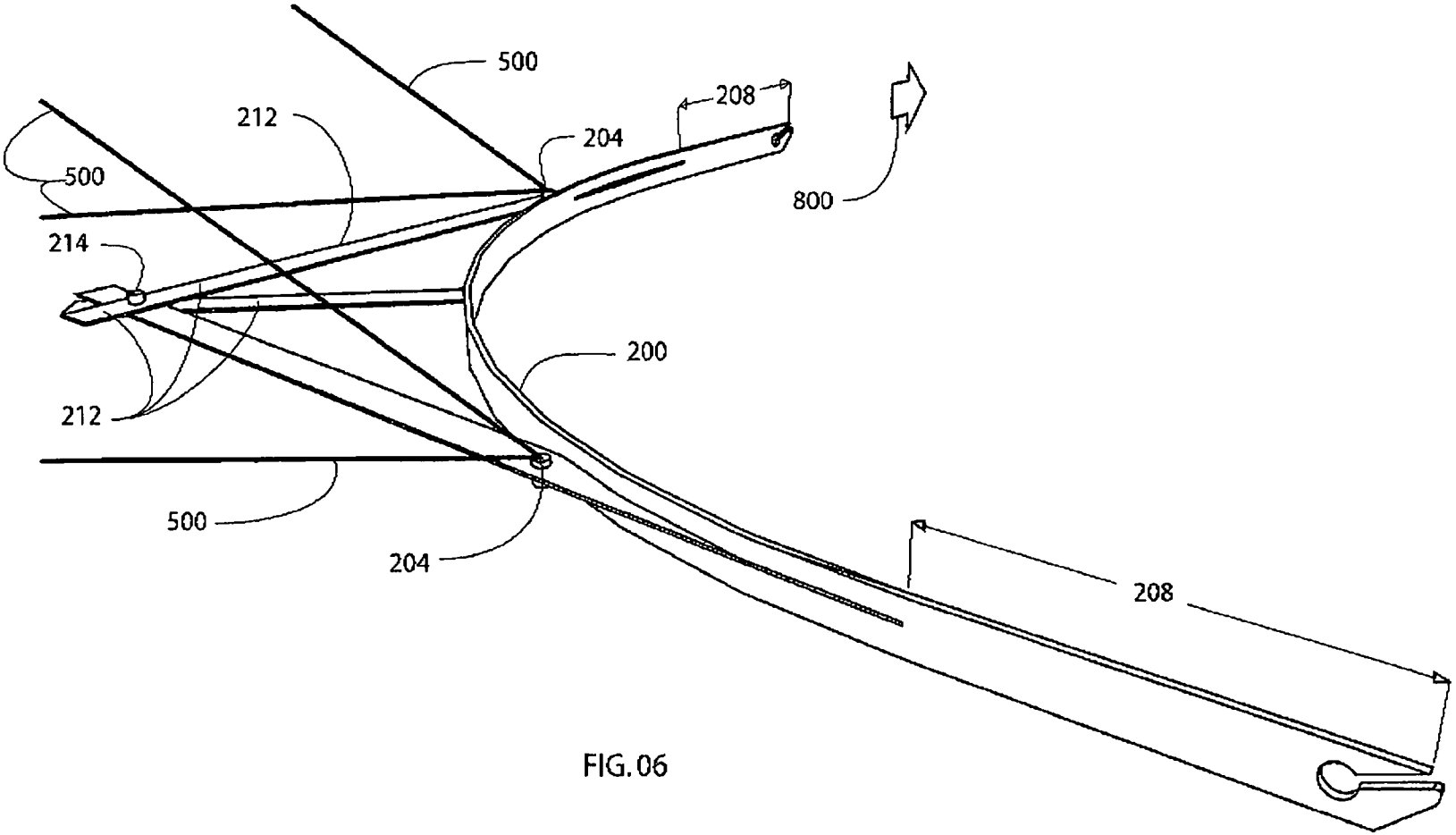
FIG. 06 shows side perspective illustration of one embodiment of a right curved track segment with flexible attachments to a support structure in accordance with the invention.

Description—FIGS. 05 and 06

FIGS. 05 and 06 shows side a perspective illustration of one embodiment of a left curve and a right curve of track segment 200 respectively, attached to track rigidity tabs 212, fastened by track rigidity tab retainer 214. Track rigidity tabs 212 are fastened to short track mount yokes 210, which are attached to flexible rigging cables 500 at attachment point 204, with rigging cables 500 being attached to a suitable ground support. At the entrance and exit of track segment ZOO are track free tabs 208. Also shown is the direction of rolling 800 of carriage 100 (not shown). Wire rope segments 400 and the termination thereof not shown.

Figure 7:
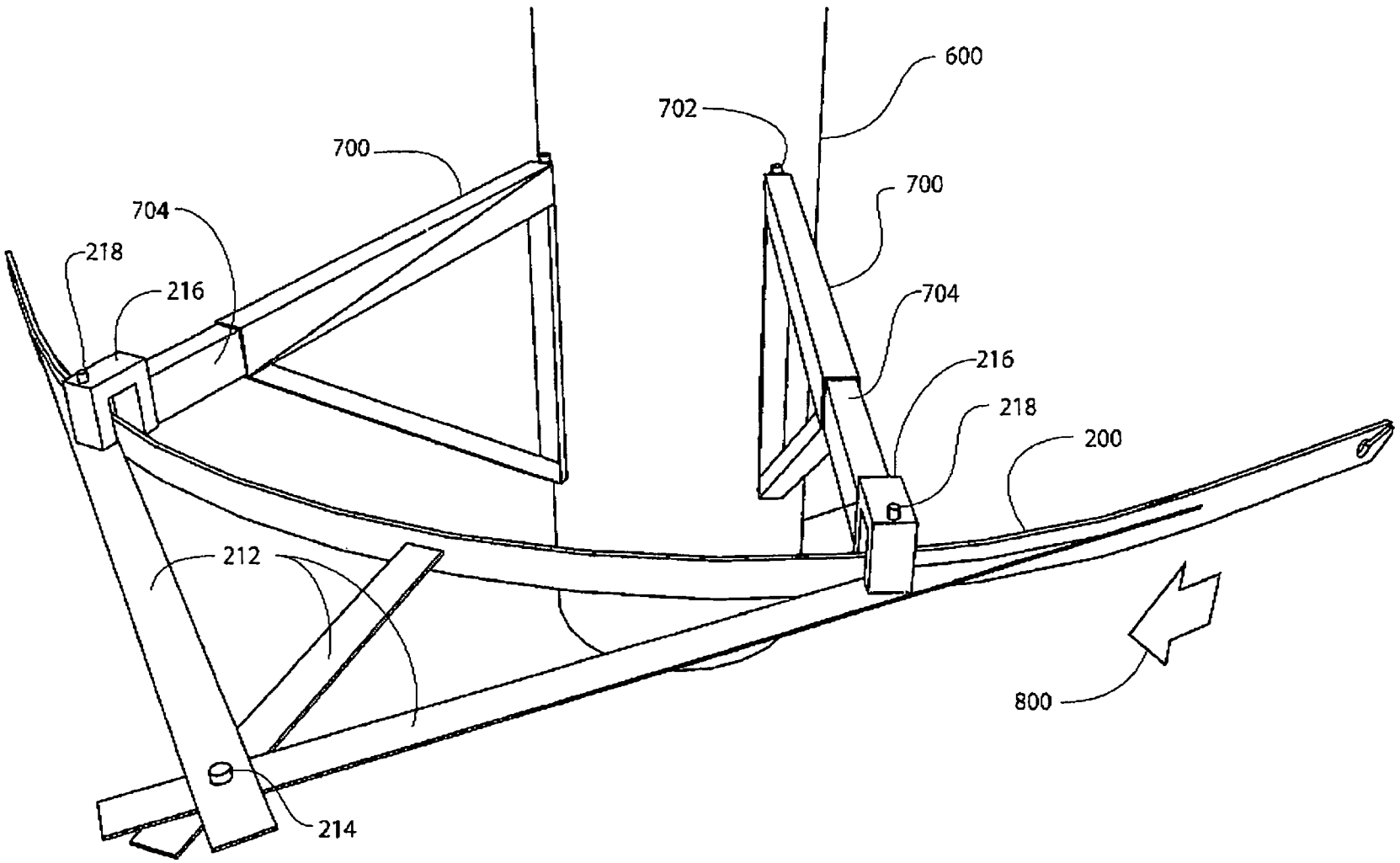
FIG. 07 shows side perspective illustration of one embodiment of a right curved track segment with rigid attachments to a support structure in accordance with the invention.

Description—FIG. 07

FIG. 07 shows side a perspective illustration of one embodiment of a right curve of track segment 200, attached to track rigidity tabs 212, fastened by track rigidity tab retainer 214. Track rigidity tabs 212 are fastened to track mount yokes 216, which are attached to track support truss telescoping boom 704 at track mount pivot 218. Track support truss telescoping boom 704 is inserted into track support truss 700 and attached so that the distance between track mount pivot 218 and track support truss pivot 702, attached to support structure 600, is adjustable. Also shown is the direction of rolling 800 of carriage 100 (not shown). Wire rope segments 400 and the termination thereof not shown.

Figure 8:
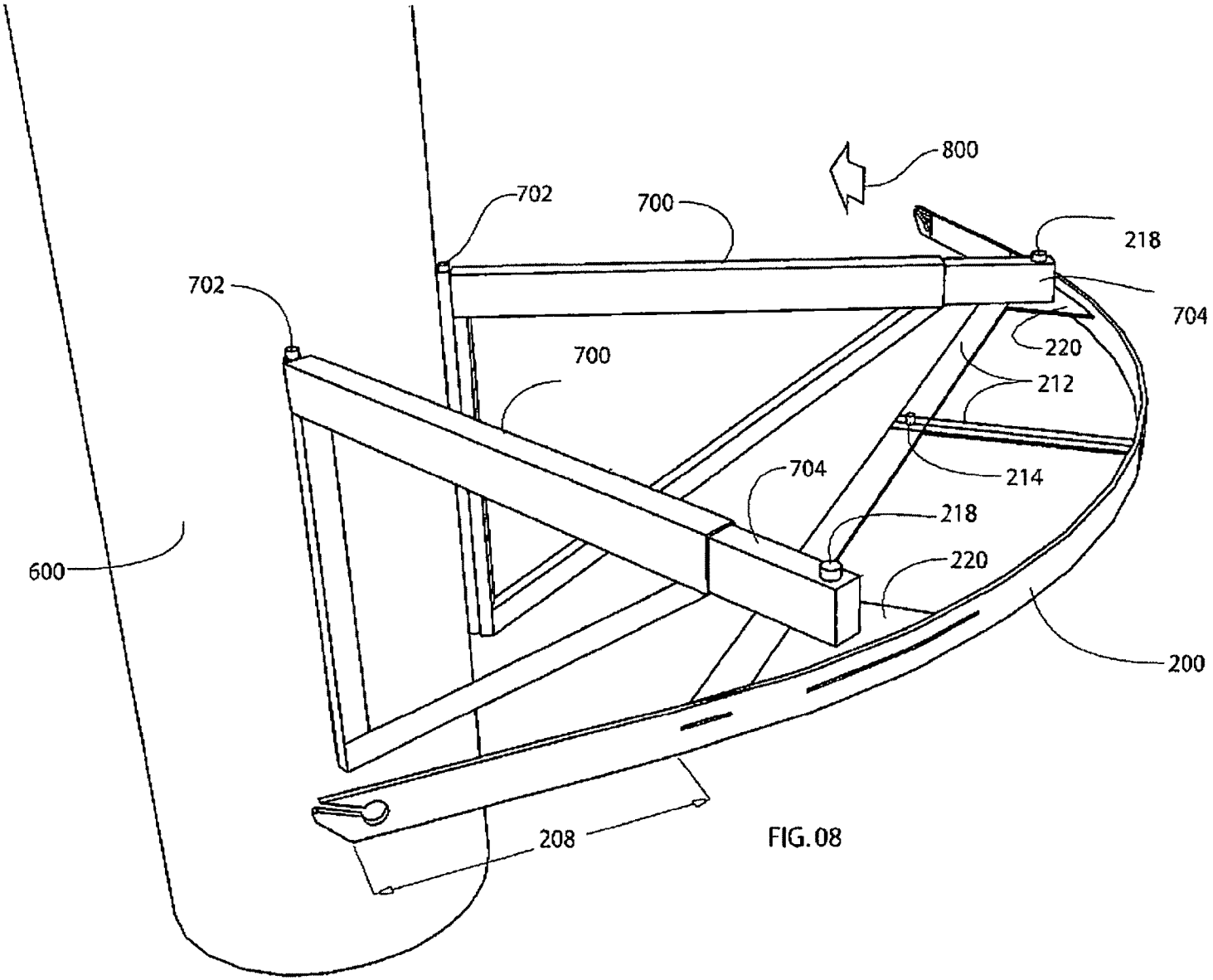
FIG. 08 shows side perspective illustration of one embodiment of a left curved track segment with rigid attachments to a support structure in accordance with the invention.

Description—FIG. 08

FIG. 08 shows side a perspective illustration of one embodiment of a left curve of track segment 200, attached to track rigidity tabs 212, fastened by track rigidity tab retainer 214. Track rigidity tabs 212 are attached to track support truss telescoping boom 704 at track mount pivot 218. Track support truss telescoping boom 704 is inserted into track support truss 700 and attached so that the distance between track mount pivot 218 and track support truss pivot 702, attached to support structure 600, is adjustable. Also shown is the direction of rolling 800 of carriage 100 (not shown). Wire rope segments 400 and the termination thereof not shown.

Figure 9:
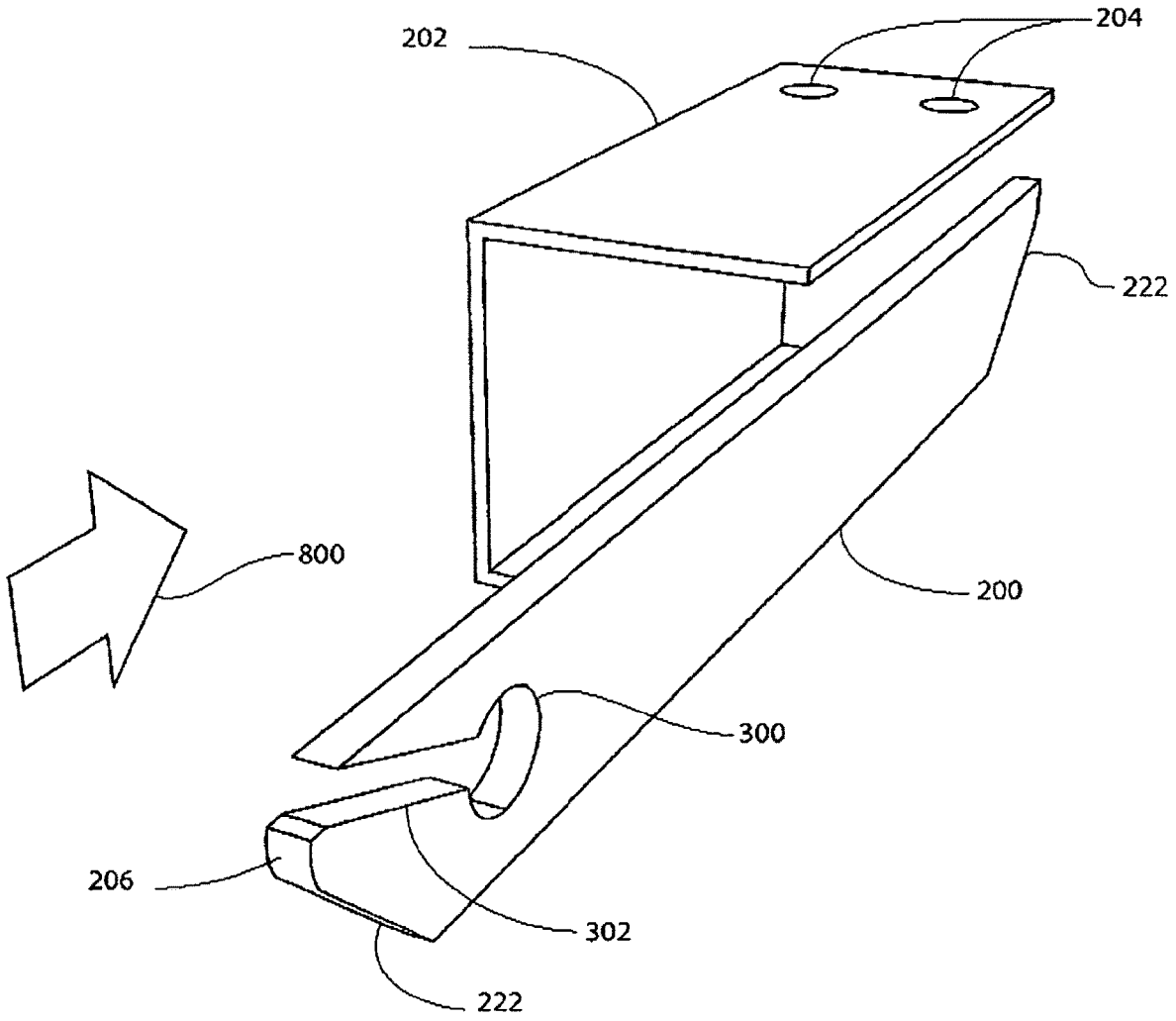
FIG. 09 shows side perspective illustration of one embodiment of an exit track segment with track hanger structure in accordance with the invention.
Figure 10:
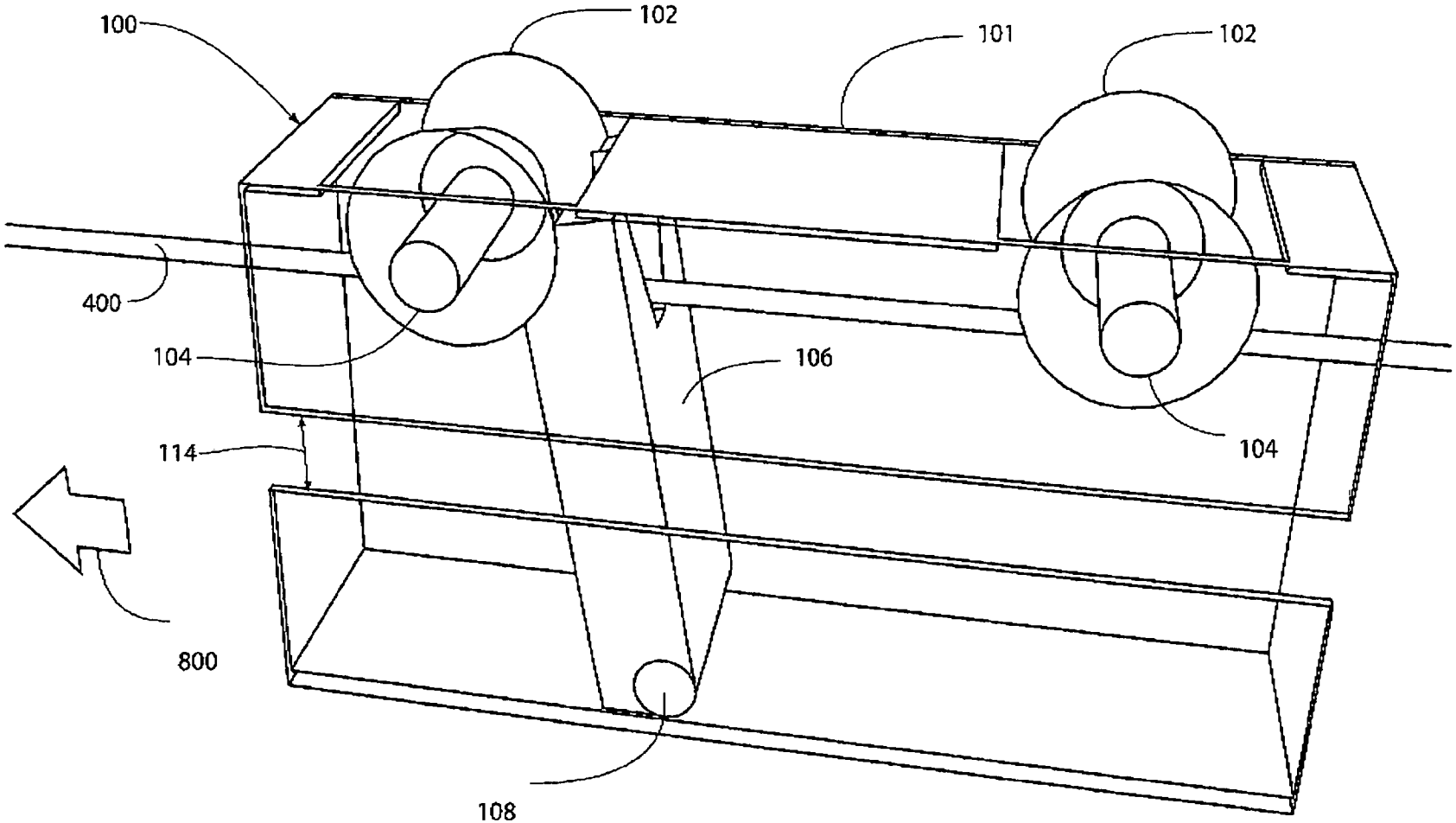
FIG. 10 shows side perspective illustration of one embodiment of a wheeled carriage rolling on a wire rope segment in accordance with the invention.
Figure 11:
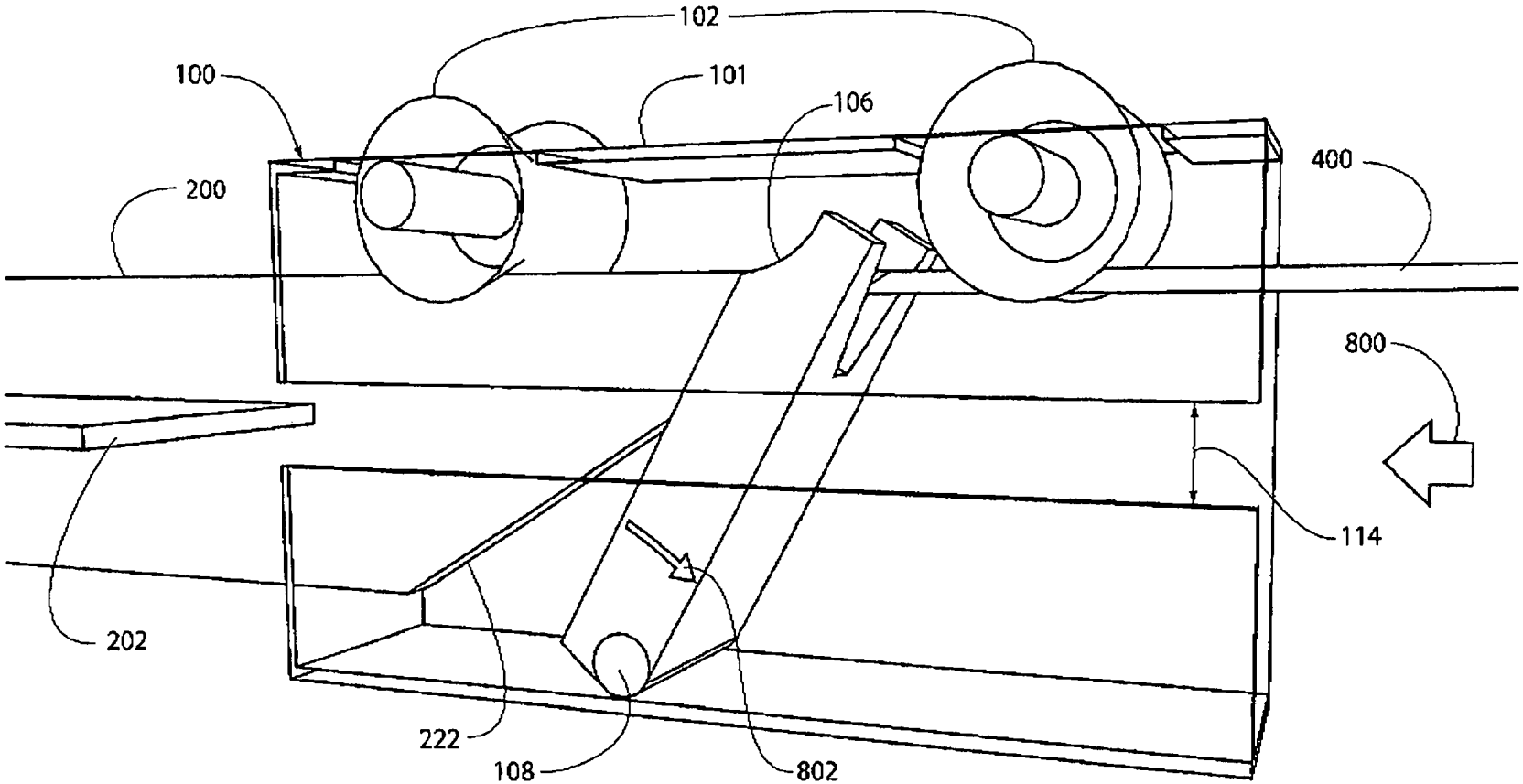
FIG. 11 shows side perspective illustration of one embodiment of a wheeled carriage rolling from a wire rope segment to a track segment in accordance with the invention.
Figure 12:
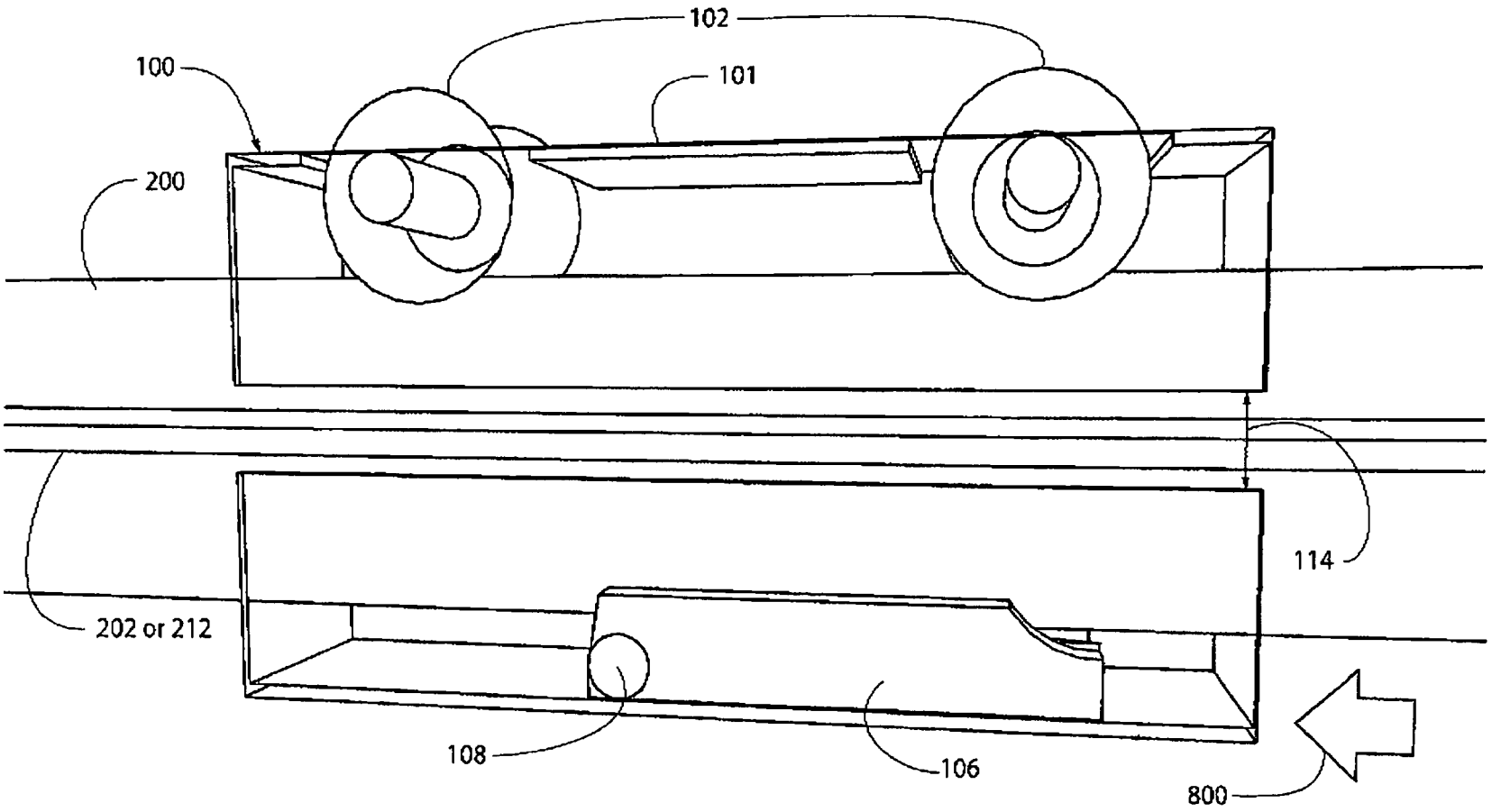
FIG. 12 shows side perspective illustration of one embodiment of a wheeled carriage rolling on a track segment in accordance with the invention.
Figure 13:
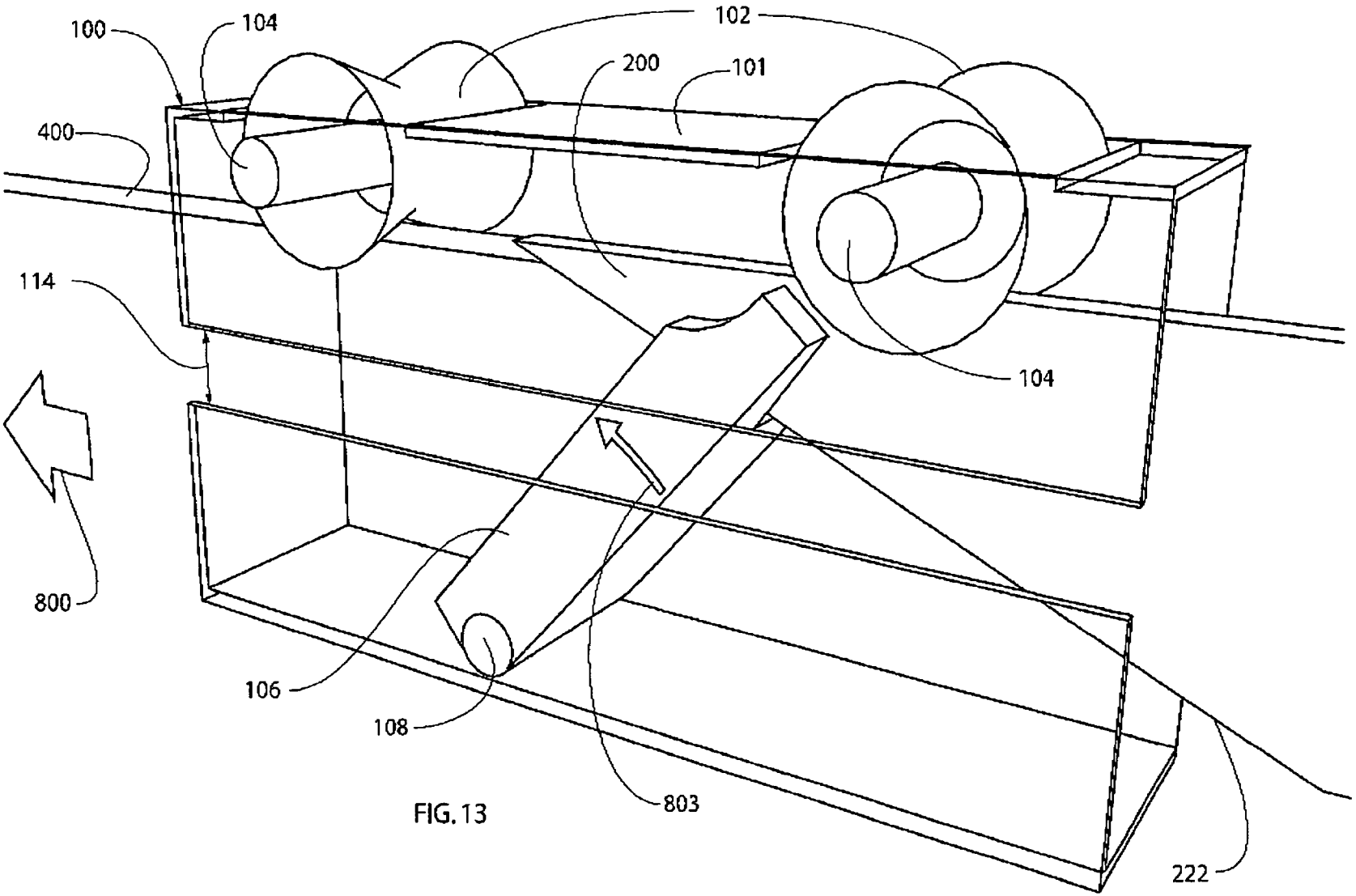
FIG. 13 shows side perspective illustration of one embodiment of a wheeled carriage rolling from a track segment to a wire rope segment in accordance with the invention.

Description—FIG. 09

FIG. 09 shows a side perspective illustration of one embodiment of an exit track segment with track segment 200 attached to track hanger 202 with track rigging attachment points 204. Also shown is the direction of rolling 800 of carriage 100 (not shown). Wire rope segments 400 and the termination thereof not shown.

Description—FIGS. 10 Through 13

FIGS. 10 through 13 show side perspective illustrations in sequence of wheeled carriage 100 with wheels 102 rolling from wire rope segment 400 to track segment 200, supported by track hanger 202, and rolling off track segment 200 onto another wired rope segment 400. Also shown is the direction of rolling 800 of carriage 100 and direction of movement for opening spring loaded retention device 802 and direction of movement for closing spring loaded retention device 803. Primary coupling swage 402 and secondary coupling swage 404 not shown.

Operation—FIG. 10 Through 13

FIGS. 10 through 13 show the operation of one embodiment of the present invention where wheels 102 of wheeled carriage 100, rolling in direction 800, pass from wire rope segment 400 onto to track segment 200, with spring loaded retention device 106 contacting retention device deactivation interface 206 (not shown) and pivoting at retention device fulcrum 108, opening spring loaded retention device 106 in direction of movement 802 to clear track segment 200 allowing wheeled carriage 100 to pass over track segment 200. Wheeled carriage 100 clears track hanger 202 or track rigidity tab 212 with pass-through slot 114. When wheeled carriage 100, rolling in direction 800, passes from track segment 200 onto wire rope segment 400, spring loaded retention device 106 disengages from track segment 200 by sliding up track segment end taper 222 closing spring loaded retention device 106 in direction of movement 803.

Figure 14:
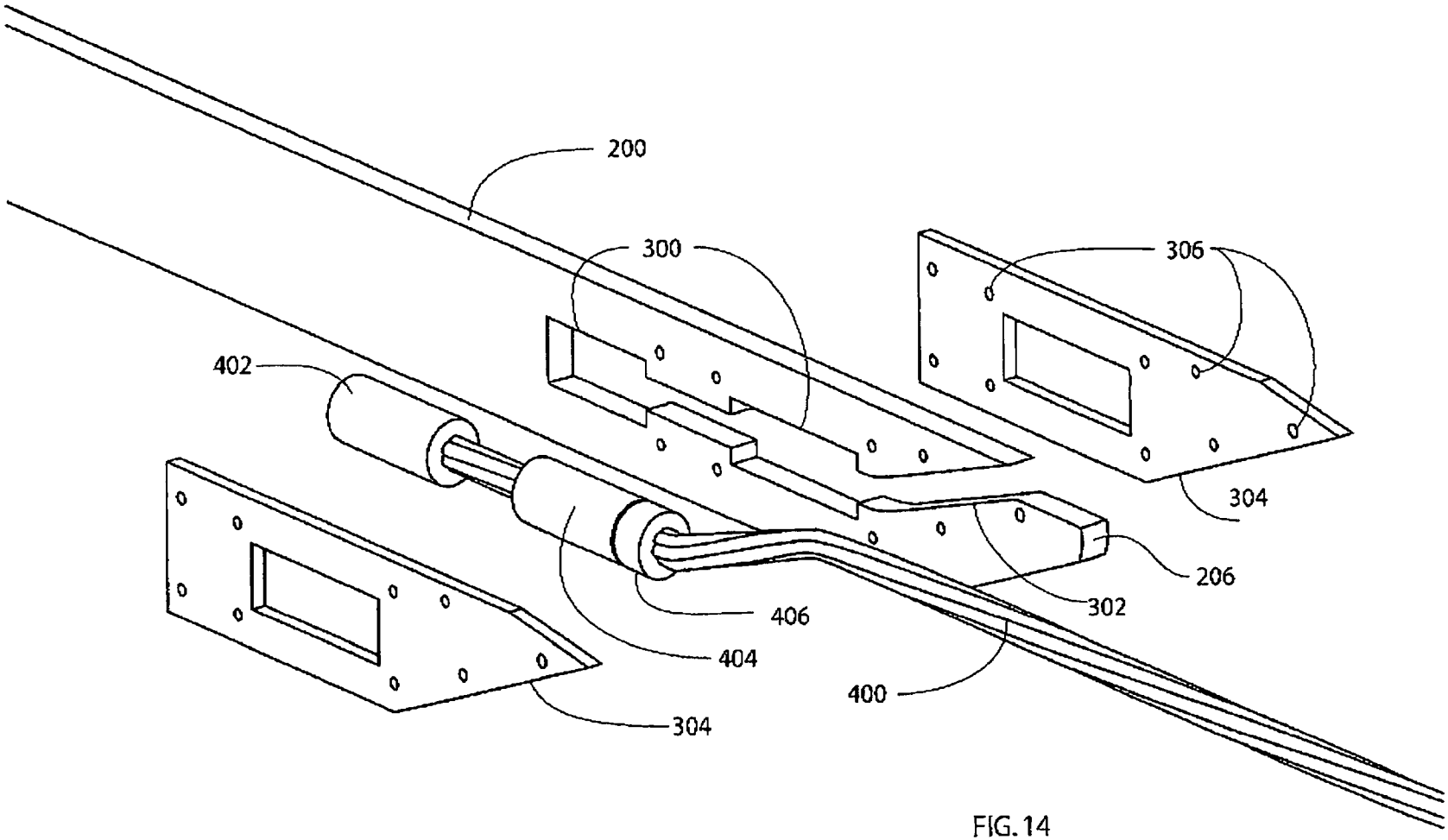
FIG. 14 shows a perspective illustration of one embodiment of a coupling where wire rope segment terminates in a track section with one or more swages, in accordance with the invention.

Description—FIG. 14

FIG. 14 shows an exploded perspective illustration of one embodiment of a coupling where wire rope segment 400 terminates in wire rope coupling sockets 300 in track segment 200 with primary coupling swage 402 and secondary coupling swage 404. Frangible indicator 406 is positioned between secondary coupling swage 404 and the edge of rope coupling socket 300. Wire rope coupling plates 304 are attached to track segment 200 using any suitable method to contain primary coupling swage 402, secondary coupling swage 404 and wire rope segment 400 in track segment 200.

Operation—FIG. 14

As a safety feature of the present invention, if primary coupling swage 402 fails, secondary coupling swage 404 will crush frangible indicator 406, releasing a bright marker that clearly indicates visually that primary coupling swage 402 has failed, at which point secondary coupling swage 404 will take up all the load.

Figure 15:
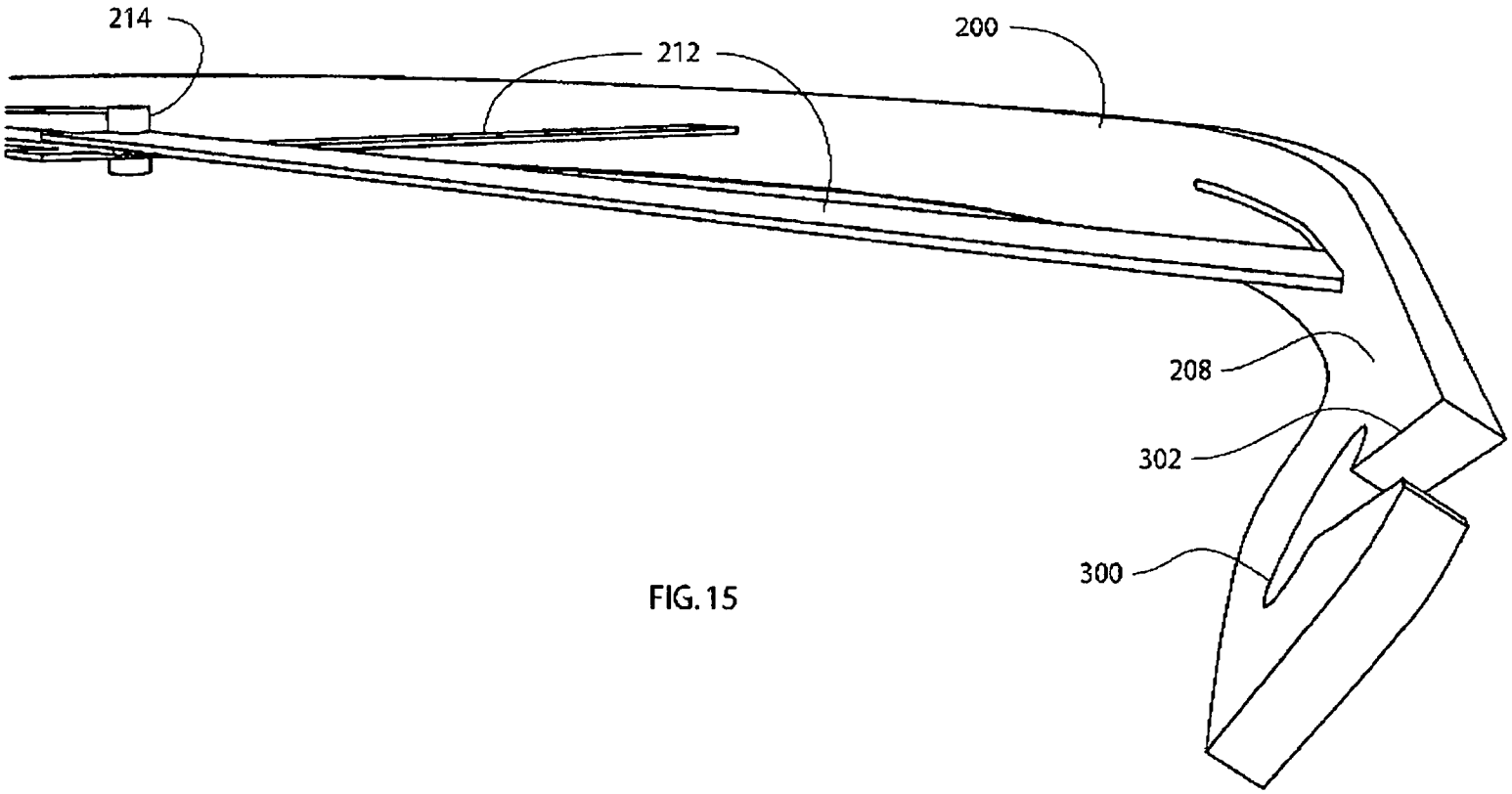
FIG. 15 shows a perspective illustration of one embodiment of a track segment being flexible and bent or twisted, in accordance with the invention.

Description—FIG. 15

FIG. 15 shows track segment 200 where track free tab 208 is flexible and bent or twisted to be aligned with wheeled carriage 100. Primary coupling swage 402 and secondary coupling swage 404 not shown.

Operation—FIG. 15

Free tab 208 is flexible and bent or twisted to be aligned with wheeled carriage 100 when centrifugal forces produce a twisting moment on wheeled carriage 100.

I claim:

1. An improved transport system comprising:

a. a plurality of wire rope segments joined by at least one segment of straight or curved track, said wire rope terminating in said track with encapsulated swages, b. a wheeled carriage that can roll on said wire rope segments and said track segments, c. means of supporting said wire rope segments or said track segments above the ground, whereby said wheeled carriage may roll from said wire rope to said track and from said track to said wire rope, wherein said wheeled carriage comprises:

one or more wheels mounted on a corresponding axle, said axle being oriented perpendicular to a direction of travel, and a spring loaded cable retention device pivotally mounted to said wheeled carriage, wherein said spring loaded cable retention device pivots at a first end on an axis parallel to said axle and comprises two prongs at a second end, and configured to retain said wire rope when in a closed position when said wheeled carriage rolls on said wire rope.

2. An improved transport system as in claim 1, wherein said wheeled carriage further comprises:

a. a latch locking device in combination with said spring loaded cable retention device, whereby said latch locking device is configured to retain said spring loaded cable retention device in said closed position when said wheeled carriage rolls on said wire rope.

3. An improved transport system as in claim 1, wherein said wheeled carriage further comprises:

a. a torsion management device comprising a friction abatement system, said friction abatement system comprising friction resistant material or wheels, whereby said torsion management device substantially manages twisting moment on said wheeled carriage when said wheeled carriage rolls on said curved track.

4. An improved transport system comprising:

a. a plurality of wire rope segments joined by at least one segment of straight or curved track, said wire rope terminating in said track with encapsulated swages, b. a wheeled carriage that can roll on said wire rope segments and said track segments, c. means of supporting said wire rope segments or said track segments above the ground, whereby said wheeled carriage may roll from said wire rope to said track and from said track to said wire rope, wherein said encapsulated swages comprise:

a primary coupling swage and a secondary coupling swage, said primary coupling swage and said secondary coupling swage being mounted in a retention device, and one or more coupling plates mounted to said retention device and configured to retain said primary coupling swage and said secondary coupling swage.

5. An improved transport system as in claim 4, wherein said encapsulated swages further comprise:

a. a frangible indicator situated between said secondary coupling swage and said retention device, whereby distortion of said frangible indicator provides visual indication of failure of said primary coupling swage.

6. An improved transport system as in claim 4, wherein said track segment further comprises:

a. a flexible free tab at an end of said track segment, whereby said flexible free tab may be bent or twisted to be aligned with, said wheeled carriage as said wheeled carriage rolls from said wire rope to said track or from said track to said wire rope.

* * * * *